US008181890B2

(12) United States Patent
Zilai et al.

(10) Patent No.: US 8,181,890 B2
(45) Date of Patent: May 22, 2012

(54) ARTICULATING AND ROTARY CLEANING NOZZLE SPRAY SYSTEM AND METHOD

(75) Inventors: Michael Shawn Zilai, Seabrook, TX (US); Charles Horace Camp, Jr., Spring, TX (US)

(73) Assignee: Nanoworx, LLC, Seabrook, TX (US)

( * ) Notice: Subject to any disclaimer, the term of this patent is extended or adjusted under 35 U.S.C. 154(b) by 497 days.

(21) Appl. No.: 12/540,469

(22) Filed: Aug. 13, 2009

(65) Prior Publication Data

US 2011/0036381 A1 Feb. 17, 2011

(51) Int. Cl.

| | |
|---|---|
| ***B05B 3/00*** | (2006.01) |
| ***B05B 3/06*** | (2006.01) |
| ***B05B 9/00*** | (2006.01) |
| ***B05B 3/12*** | (2006.01) |

(52) U.S. Cl. .... 239/227; 239/253; 134/22.1; 134/167 R; 134/168 R; 134/172; 134/191

(58) Field of Classification Search ..... 239/227, 239/237, 253, 256, 263, 263.1; 134/22.1, 134/22.18, 24, 166 R, 167 R, 168 R, 172, 134/176, 179, 191

See application file for complete search history.

(56) References Cited

U.S. PATENT DOCUMENTS

| | | | | |
|---|---|---|---|---|
| 2,245,554 | A | 6/1941 | Court | |
| 3,420,444 | A | 1/1969 | Ajnefors | |
| 3,601,136 | A * | 8/1971 | Marcham | 134/167 R |
| 3,874,594 | A * | 4/1975 | Hatley | 239/227 |
| 3,931,930 | A | 1/1976 | Waldrum | |
| 4,056,227 | A | 11/1977 | Fismen | |
| 5,020,556 | A | 6/1991 | Lamminen et al. | |
| 5,217,166 | A | 6/1993 | Schulze et al. | |
| 5,395,053 | A | 3/1995 | Frech | |
| 5,715,852 | A * | 2/1998 | Jepsen | 134/167 R |
| 5,896,871 | A * | 4/1999 | Larsen | 134/22.1 |

(Continued)

FOREIGN PATENT DOCUMENTS

| | | |
|---|---|---|
| DE | 19 61 823 | 7/1970 |

(Continued)

OTHER PUBLICATIONS

Gamajet Cleaning Systems, Inc., Product Data. "Gamajet IV 'GT' Tank Cleaning Machine." Gamajet Cleaning Systems, Inc., copyrighted 2002 [retrieved from the Internet on Aug. 19, 2009 using <URL: http://gamajet.com/media/images/pdf/4GTdata.pdf>].

(Continued)

*Primary Examiner* — Len Tran
*Assistant Examiner* — Ryan Reis
(74) *Attorney, Agent, or Firm* — Locke Lord LLP

(57) ABSTRACT

The present disclosure provides a system and method for a cleaning apparatus that includes a swash assembly for allowing independent control of the nozzle pitch from the nozzle rotation, and further includes supplying a cleaning fluid through the same apparatus used to rotate the nozzle. The method and system allows cleaning with spray patterns of substantially 360 degrees spherical ranges of motion. The nozzle angle can be controlled by hydraulic cylinders that can reversibly translate a rack along a longitudinal axis of a nozzle assembly to engage a pitch gear coupled to the nozzle. The system is automatically resettable to a default position upon failure of hydraulic pressure. Generally, a plurality of nozzles are used to balance the side forces on the main mast. A remote control system allows an operator to design and control an optimal cleaning procedure, and to adjust the nozzle rotation, angle, and cleaning regime.

18 Claims, 7 Drawing Sheets

U.S. PATENT DOCUMENTS

| | | | | |
|---|---|---|---|---|
| RE36,465 | E | 12/1999 | Boisture | |
| 6,039,056 | A * | 3/2000 | Verbeek | 134/22.18 |
| 6,422,480 | B1 | 7/2002 | Richmond | |
| 6,561,199 | B2 | 5/2003 | Gleeson et al. | |
| 6,640,817 | B2 | 11/2003 | Harmon | |
| 7,300,000 | B2 | 11/2007 | Kitamura et al. | |
| 2004/0089329 | A1 * | 5/2004 | Bijster | 134/167 R |
| 2006/0065760 | A1 | 3/2006 | Micheli | |

FOREIGN PATENT DOCUMENTS

| | | |
|---|---|---|
| GB | 1 237 237 | 6/1971 |
| GB | 2 028 113 | 3/1980 |
| WO | 02/47825 | 6/2002 |
| WO | 2004/103586 | 12/2004 |

OTHER PUBLICATIONS

Gamajet Cleaning Systems, Inc., Product Data. "Gamajet V Tank Cleaner." Gamajet Cleaning Systems, Inc., copyrighted 2006 [retrieved from the Internet on Aug. 19, 2009 using <URL: http://gamajet.com/media/images/pdf/5data.pdf>].

Gamajet Cleaning Systems, Inc., Product Data. "Gamajet VI Tank Cleaner." Gamajet Cleaning Systems, Inc., copyrighted 2007 [retrieved from the Internet on Aug. 19, 2009 using <URL: http://gamajet.com/media/images/pdf/6data.pdf>].

Gamajet Cleaning Systems, Inc., Product Data. "Gamajet E-Z7 Barrel Blaster." Gamajet Cleaning Systems, Inc., copyrighted 2002 [retrieved from the Internet on Aug. 19, 2009 using <URL: http://gamajet.com/media/images/pdf/7data.pdf>].

Gamajet Cleaning Systems, Inc., Product Data. "Gamajet E-Z8 Tank Cleaner." Gamajet Cleaning Systems, Inc., copyrighted 2002 [retrieved from the Internet on Aug. 19, 2009 using <URL: http://gamajet.com/media/images/pdf/8data.pdf>].

Gamajet Cleaning Systems, Inc., Product Data. "Gamajet IX Tote Blaster Tank Cleaner." Gamajet Cleaning Systems, Inc., copyrighted 2003 [retrieved from the Internet on Aug. 19, 2009 using <URL: http://gamajet.com/media/images/pdf/9data.pdf>].

Gamajet Cleaning Systems, Inc., Product Data. "Gamajet X." Gamajet Cleaning Systems, Inc., copyrighted 2006 [retrieved from the Internet on Aug. 19, 2009 using <URL: http://gamajet.com/media/images/pdf/10data.pdf>].

Gamajet Cleaning Systems, Inc., Product Data. "Gamajet 88." Gamajet Cleaning Systems, Inc., copyrighted 2007 [retrieved from the Internet on Aug. 19, 2009 using <URL: http://gamajet.com/media/images/pdf/88data.pdf>].

AutoJet Technologies Products and Services. "Spray Nozzles & Accessories." AutoJet Technologies is a division of Spraying Systems Co., copyrighted 2006 [retrieved from the Internet on Aug. 19, 2009 using <URL: http://www.autojet.com/products/nozzles.asp>].

AutoJet Technologies Products and Services. "Tank Cleaning Systems." AutoJet Technologies is a division of Spraying Systems Co., copyrighted 2006 [retrieved from the Internet on Aug. 19, 2009 using <URL: http://www.autojet.com/tankwash/reference.asp>].

Oreco A/S. "The BLABO Tank Cleaning and Oil Recovery Process." Oil storage tank cleaning and oil recovery solutions, Oreco A/S, copyrighted 2005-2008 [retrieved from the Internet on Aug. 19, 2009 using <URL: http://www.oreco.com/sw6274.asp>].

AutoJet Technologies Products and Services. "AutoJetTank Cleaning Systems." AutoJet Technologies is a division of Spraying Systems Co., copyrighted 2006 [retrieved from the Internet on Aug. 19, 2009 using <URL: http://www.autojet.com/pdf/AT157B-TankCleaning.pdf.asp>].

Oreco A/S, Brochure. "BLABO Non-man entry tank cleaning and oil recovery system." Oreco A/S, copyrighted 2007 [retrieved from the Internet on Aug. 19, 2009 using <URL: http://www.oreco.com/graphics/File/PDF/BLABO-uk.pdf>].

Gamajet Cleaning Systems, Inc., Product Data. "Gamajet Directional Units." Gamajet Cleaning Systems, Inc., copyrighted 2007 [retrieved from the Internet on Aug. 19, 2009 using <URL: http://gamajet.com/media/images/pdf/directional_data.pdf>].

Gamajet Cleaning Systems, Inc., Product Data. "Evacu-Blast and Gamavac: Portable Barrel Cleaning Equipment for Top-Down Cleaning Convenience." Gamajet Cleaning Systems, Inc., copyrighted 2005 [retrieved from the Internet on Aug. 19, 2009 using <URL: http://gamajet.com/media/images/pdf/evacublast-gamavac.pdf>].

Oreco A/S, Brochure. "Oreco's MoClean system: Automated cleaning of oil product tanks." Copyright Oreco A/S, [retrieved from the Internet on Aug. 19, 2009 using <URL: http://www.oreco.com/graphics/File/PDF/Moclean-process-uk.pdf>].

Oreco A/S, Brochure. "SNS-200: Single Nozzle Sweeper" Copyright Oreco A/S, [retrieved from the Internet on Aug. 19, 2009 using <URL: http://www.oreco.com/graphics/File/PDF/Optional-sns200-uk.pdf>].

Oreco A/S, Brochure. "TZ-68: Rotary Jet Head" Copyright Oreco A/S, [retrieved from the Internet on Aug. 19, 2009 using <URL: http://www.oreco.com/graphics/File/PDF/Press/Optional-tz68-uk.pdf>].

Appelt, L., International Search Report for International Patent Application No. PCT/US2010/042896, European Patent Office, dated Oct. 21, 2010.

Appelt, L., Written Opinion for International Patent Application No. PCT/US2010/042896, European Patent Office, dated Oct. 21, 2010.

* cited by examiner

ARTICULATING AND ROTARY CLEANING NOZZLE SPRAY SYSTEM AND METHOD

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This disclosure relates a system and method of cleaning surfaces with fluid. More specifically, the disclosure relates to a system and method for cleaning tanks, vessels, and other enclosed volumes with articulating and rotating spray nozzles.

2. Description of the Related Art

Tanks, vessels, and other enclosed volumes routinely require cleaning. The challenge is to clean the surfaces of the enclosed volumes and other structures sufficiently to accept the next process in minimal time and with minimal cleaning fluid. Current market trends demand minimal time and minimal expense. Current environmental trends demand minimal fluid usage. Current safety trends demand minimal entry by personnel into confined spaces. Enclosed volumes are especially challenging. The contours of the inner surfaces and restricted access of enclosed surfaces make a difficult job more demanding.

Prior efforts have attempted to solve the challenges of cleaning enclosed volumes. Examples include U.S. Pat. Nos. 2,245,554, 3,420,444, 3,931,930, 4,056,227, 5,020,556, 5,217,166, 5,395,053, 5,896,871, 6,422,480, 6,561,199, 6,640,817, 7,300,000, Re. 36,465, and US Publ. No. 2006/0065760. Commercial systems are also available for review on the Internet including: www.autojet.com/tankwash/reference.asp, www.gamajet.com/products/iv.html, and www.oreco.com/sw17371.asp. Most of the spray systems include one or more rotating nozzles about a longitudinal axis of the spray systems and many include telescoping the nozzle(s) into the enclosed volume. In some disclosures, the cleaning fluid is the driving medium for the rotation. In some disclosures, a nozzle is angularly fixed as it is rotated about the longitudinal axis within the enclosed volume. In some disclosures, the nozzles can be moved to different angles and oscillate during the rotation, but are dependent on the rotation. In some disclosures, the nozzle angle may be independently controlled from the rotation.

However, the mode of changing nozzle angles during rotation is not entirely satisfactory with current known systems. The degree and ease of control, speed, and efficiency are believed to have commercial limitations with known systems. A different system and method is needed.

BRIEF SUMMARY OF THE INVENTION

The present disclosure provides a system and method for a cleaning apparatus that includes a swash assembly for allowing independent control of the pitch of the spray angle of the nozzle from the rotation of the nozzle, and further includes a system for supplying a cleaning fluid through the same apparatus used to rotate the nozzle. The system and method yield a highly compact and efficient cleaning apparatus capable of cleaning in spray patterns of substantially 360 degrees spherical ranges of motion. The nozzle angle can be controlled by one or more hydraulic cylinders that translate a rack along a longitudinal axis of a nozzle assembly to engage a pitch gear coupled to the nozzle. The independent rotation of the nozzle is absorbed during the rack translation by a swash plate mounted to a swash base. The nozzle angle and rotation can each be reversed and varied in speed. The system can be automatically resettable to a default position, such as a zero azimuth angle for the nozzle, upon a failure of hydraulic pressure. Generally, a plurality of nozzles are used to balance the side forces on the main mast. A remote control system allows an operator to design and control an optimal cleaning procedure, and to adjust the nozzle rotation, angle, and cleaning regime.

The disclosure provides an articulating nozzle system for cleaning, comprising an articulating turret head assembly, a mast assembly coupled to the articulating turret head assembly, and a motion base assembly coupled to the mast assembly. The articulating turret head assembly comprises a turret head housing and an articulating nozzle rotary union assembly coupled to turret head housing, comprising: a body of the nozzle rotary union assembly coupled to the turret head housing, the body having a flow passage therethrough; a nozzle coupled to the body of the nozzle rotary union assembly and having flow passage therethrough fluidicly coupled to the flow passage in body of the nozzle rotary union assembly; and a nozzle union pitch gear coupled to the body of the nozzle rotary union assembly. The mast assembly comprises a swash assembly comprising: a swash base; a swash plate linearly coupled with the swash base and rotationally decoupled with the swash base; and a push tube coupled with the swash base. The mast assembly further comprises a rack rotationally coupled with the swash plate and turret head assembly and further slidably coupled with the turret head assembly and rotationally decoupled with the push tube, the rack being adapted to engage and rotate the nozzle union pitch gear to rotate the nozzle to different azimuth angles. The mast assembly further comprises a center mast tube disposed radially within the swash assembly and passing through the swash assembly, the center mast tube being adapted to engage and cause rotation of the articulating turret head assembly independent of linear movement of the swash assembly with the rack being rotationally coupled to the center mast tube through the coupling with the articulating turret head assembly, the center mast tube further comprising a flow passage formed therethrough that is fluidicly coupled to the flow passage in the nozzle rotary union assembly and the nozzle; the swash assembly being adapted to allow the rack to change the azimuth angle of the nozzle while the center mast tube rotates the turret head assembly coupled with the nozzle. The motion base assembly includes at least one support structure and comprises: a push tube actuator assembly coupled to the at least one support structure on the base assembly, the push tube actuator assembly adapted to linearly move the push tube and the swash assembly; and a motor coupled to the at least one support structure and to the center mast tube and adapted to rotate the center mast tube and the turret head assembly.

The disclosure also provides an articulating nozzle system for cleaning, comprising an articulating turret head assembly, a mast assembly coupled to the articulating turret head assembly and a motion base assembly coupled to the mast assembly. The articulating turret head assembly comprises a turret head housing; and an articulating nozzle rotary union assembly coupled to the turret head housing, comprising: a body of the nozzle rotary union assembly coupled to the turret head housing, the body having a flow passage therethrough; and a nozzle coupled to the body of the nozzle rotary union assembly and having flow passage therethrough fluidicly coupled to the flow passage in body of the nozzle rotary union assembly. The mast assembly comprises: a swash assembly adapted to change an azimuth angle of the nozzle, comprising: a swash base and a swash plate linearly coupled with the swash base and rotationally decoupled with the swash base; a push tube coupled with the swash base and to the nozzle rotary union assembly; and a center mast tube coupled to the turret head assembly and adapted to engage and cause rotation of the articulating turret head assembly independent of linear movement of the swash assembly, the center mast tube further comprising a flow passage formed therethrough that is fluidicly coupled to the flow passage in the nozzle rotary union assembly and the nozzle. The motion base assembly comprises a push tube actuator assembly coupled to the base assembly, the push tube actuator assembly adapted to linearly move the push tube and the swash assembly to change an azimuth angle of the nozzle.

DETAILED DESCRIPTION

Figure 1:
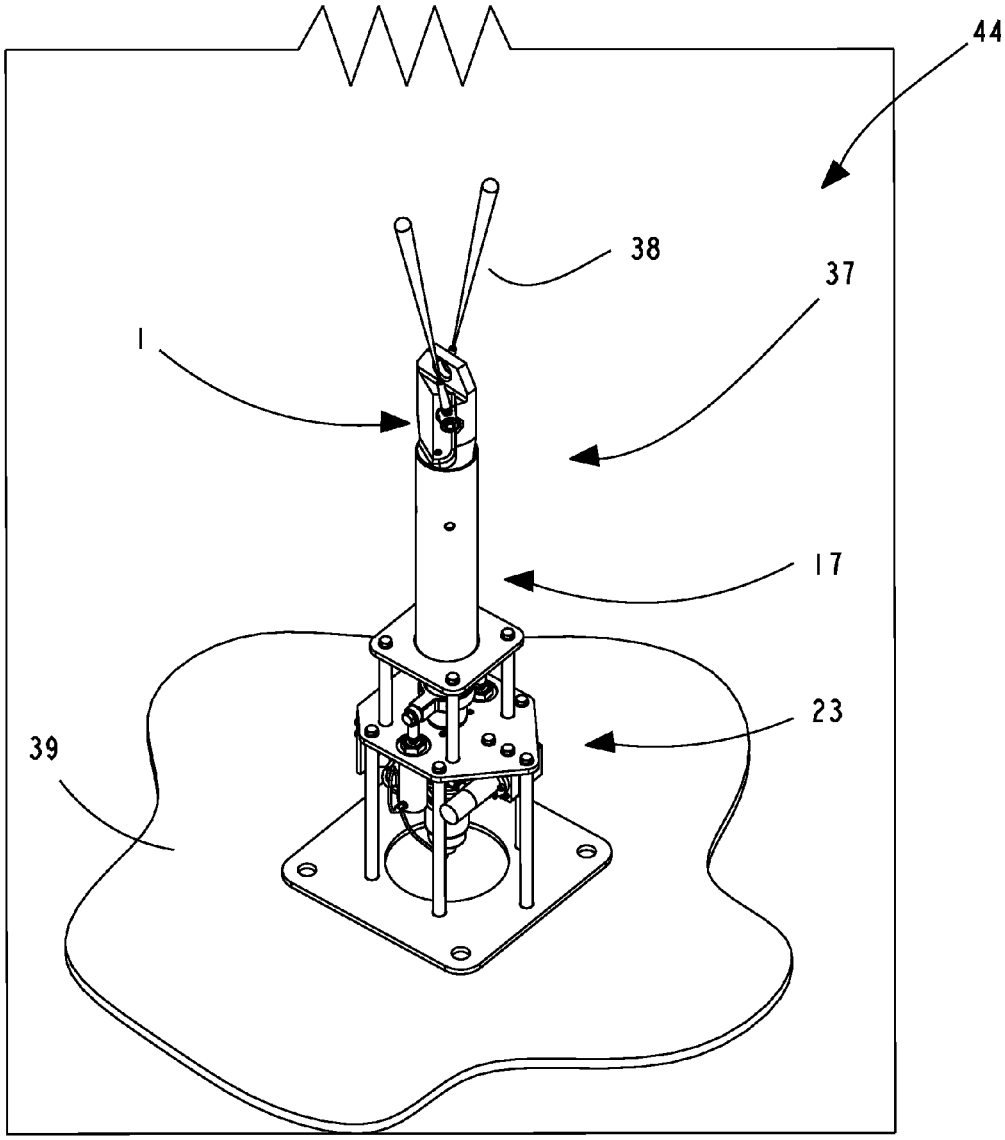
FIG. 1 is a schematic perspective view of an exemplary articulating nozzle assembly according to the current disclosure disposed in an at least partially enclosed volume.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, elements have been labeled with an "a" or "b" to designate one side of the system or another. When referring generally to such elements, the number without the letter is used. Further, such designations do not limit the number of elements that can be used for that function.

In general, the present disclosure provides a system and method for a cleaning apparatus that includes a swash assembly for allowing independent control of the pitch of the spray angle of the nozzle from the rotation of the nozzle, and further includes a system for supplying a cleaning fluid through the same apparatus used to rotate the nozzle. The system and method yield a highly compact and efficient cleaning apparatus capable of cleaning in spray patterns of substantially 360 degrees spherical ranges of motion. The nozzle angle can be controlled by one or more hydraulic cylinders that translate a rack along a longitudinal axis of a nozzle assembly to engage a pitch gear coupled to the nozzle. As the pitch gear rotates, the nozzle can change azimuth (pitch) angles. The independent rotation of the nozzle is absorbed during the rack translation by a swash assembly having a swash plate mounted to a swash base. The system is automatically resettable to a default position, such as a zero azimuth angle for the nozzle, upon a failure of hydraulic pressure. Generally, a plurality of nozzles are used to balance the side forces on the main mast. A remote control system allows an operator to design and control an optimal cleaning procedure, and to adjust the nozzle rotation, angle, and cleaning regime. The system further includes a feedback loop for validating the position of the nozzle.

Figure 2:
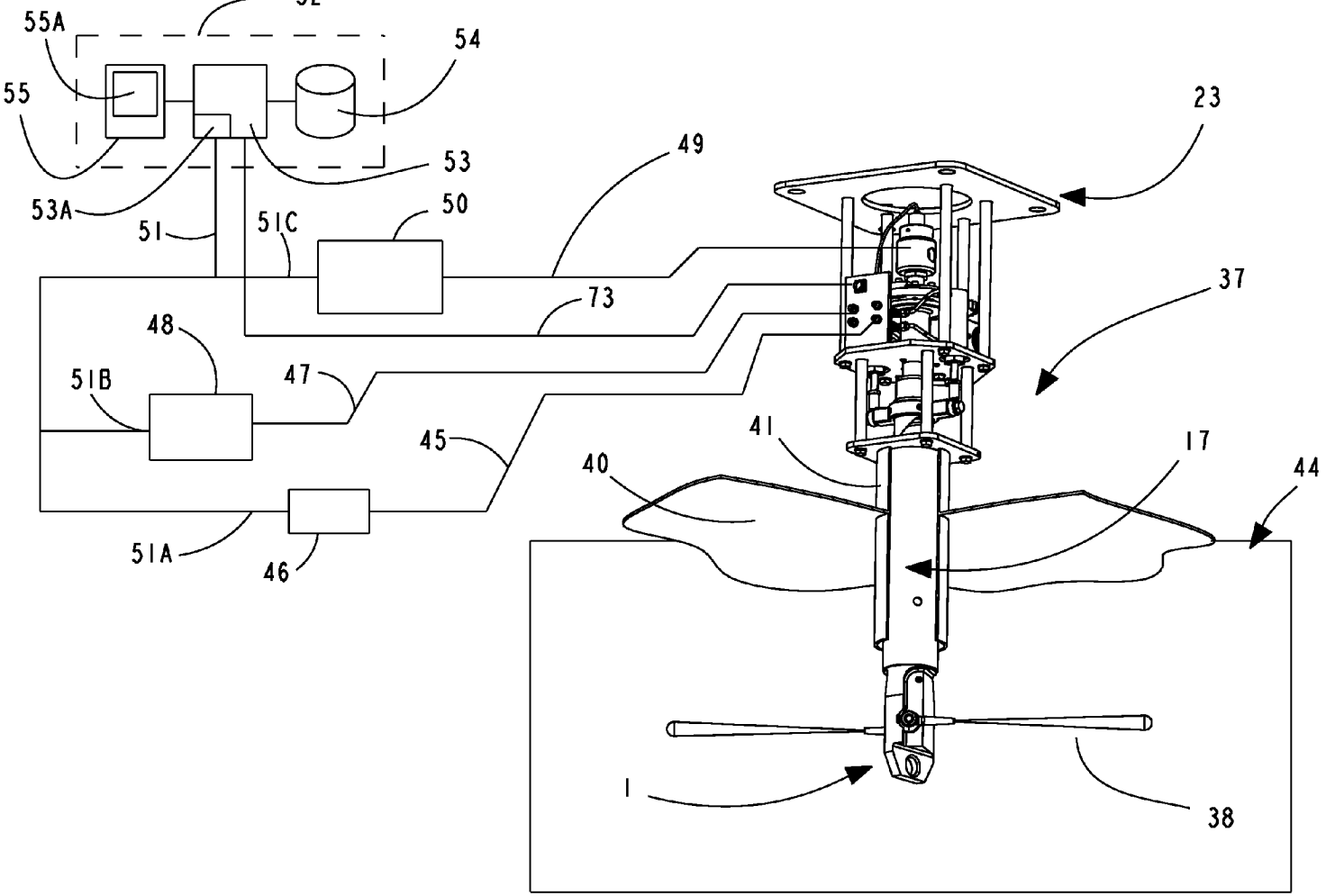
FIG. 2 is a schematic perspective view of the articulating nozzle assembly in an alternative mounting position in the enclosed volume.

FIG. 1 is a schematic perspective view of an exemplary articulating nozzle assembly according to the current disclosure disposed in an at least partially enclosed volume. FIG. 2 is a schematic perspective view of the articulating nozzle assembly in an alternative mounting position in the enclosed volume. The figures will be described in conjunction with each other. An articulating nozzle system 37 includes a stationary motion base assembly 23, a mast assembly 17, and the articulating turret head assembly 1. The articulating nozzle system 37 with the motion base assembly 23 can be coupled to the floor 39 (FIG. 1), to or through the ceiling (FIG. 2), or in other suitable positions of the at least partially enclosed volume 44. When inserted into the enclosed volume, the mast assembly 17 can be inserted through a riser 41 coupled to the surface of the enclosed volume 44. The riser can provide a structural support for the articulating nozzle system 37 during spraying operations. The mast assembly 17 is fixed and does not move within the riser 41 and is of sufficient length to position the rotating turret head assembly 1 into the interior of the enclosed volume, free from the obstruction of the riser 41. In the exemplary illustrations, a jet spray 38 is shown spraying upward (FIG. 1) or radially outward (FIG. 2), and other articulated positions are contemplated. The articulating turret head assembly 1 houses one or more nozzles and the mechanisms to articulate the nozzles to different positions, described below. The articulating turret head assembly 1 can rotate independently of the mast assembly 17 to direct the spray from the nozzles around the enclosed volume 44. Further, the speed of the nozzle in azimuth and heading directions, described below, can be variable and the direction of can be reversible, which capabilities provide wide flexibility to spray patterns and procedures.

The articulating nozzle system 37 can include various power sources for operation. For example, at least one pitch control power line 45 can be used to flow control fluid from a pitch control power supply 46 to one or more fluid actuated cylinders, described below, to provide pitch movement for the nozzle. At least one rotary control power line 47 can provide power from a rotary control power supply 48 to the articulating nozzle system 37 to provide heading movement for the nozzle. Further, at least one cleaning fluid line 49 can provide cleaning fluid from a cleaning fluid power supply 50 to the articulating nozzle system 37. The cleaning fluid is generally delivered at a high-pressure of several thousand pounds per square inch from the cleaning fluid power supply 50, which is generally an application-specific pump of such types as centrifugal, piston and airless pumps.

The articulating nozzle system 37 can also include controls, such as onsite controls to operate the system. Control lines 51A, 51B, and 51C for the power supplies 46, 48, 50, respectively, can couple control of the power supplies to a control center 52. In turn, each of the power supplies 46, 48, 50 are coupled to a power line or power supply 45, 47, 49, respectively, and directed to the particular portion of the applicable assembly, described in more detail below. In some embodiments, one or more of the controls can be disposed on the articulating nozzle system 37. The control center 52 can generally include a controller 53A coupled with a processor 53, such as a standalone or networked computer or server, having volatile and/or non-volatile memory and associated software, firmware, and hardware. The processor 53 can be coupled to a database 54 having computer readable medium of one or more types for records, and other information as needed for the control, monitoring, and reporting of the articulating nozzle system 37. An input/output device 55, such as a display with a graphical user interface 55A (GUI) screen, can provide reporting and allow an operator to control and/or monitor the operation of the articulating nozzle system 37. For example, an operator can use the interface 56 to enter a diameter and height of a vessel, and a program prompts the operator with a few questions designed to determine the optimal cleaning program along with suggested run times and consumables requirements. The operator can select the suggestions or enter other parameters to operate the articulating nozzle system 37.

The combination of separately controlling the two axes of rotation and nozzle angle enables the articulating nozzle system 37 to spray the interior surfaces of the enclosed area 44 in a virtually infinite number of adjustable patterns such as spirals or zigzags, where each pattern can be engineered to create optimized cleaning program for the task. Multiple nozzles can be linked together to provide synchronized coverage across a large array, minimizing overlapping areas. The motion control capabilities allow the articulating nozzle system 37 to target programmed areas of special need. In some embodiments, the articulating nozzle system can return to target areas between pattern changes. For example, each cycle can begin at the same point inside the enclosed volume for consistent precise application times. To assist in locating the positions of the two axes of rotation and nozzle angle, one or more sensors 71, 72 can be positioned on the system and coupled to the control center 52. The sensors 71, 72 can indicate the heading and pitch of the nozzle and/or turret head assembly. The positional readings can be sent to the control center 52 as feedback through a feedback control line 73.

The control center 52 can also be located at a remote site. The controls can be set up in a customary manner using various types of remote interfaces between a remote site and a job site, including using networks such as LANs, WANs, and other types of Internet sites, such as FTP (File Transfer Protocol) sites, Telnet sites, and the like.

Figure 3:
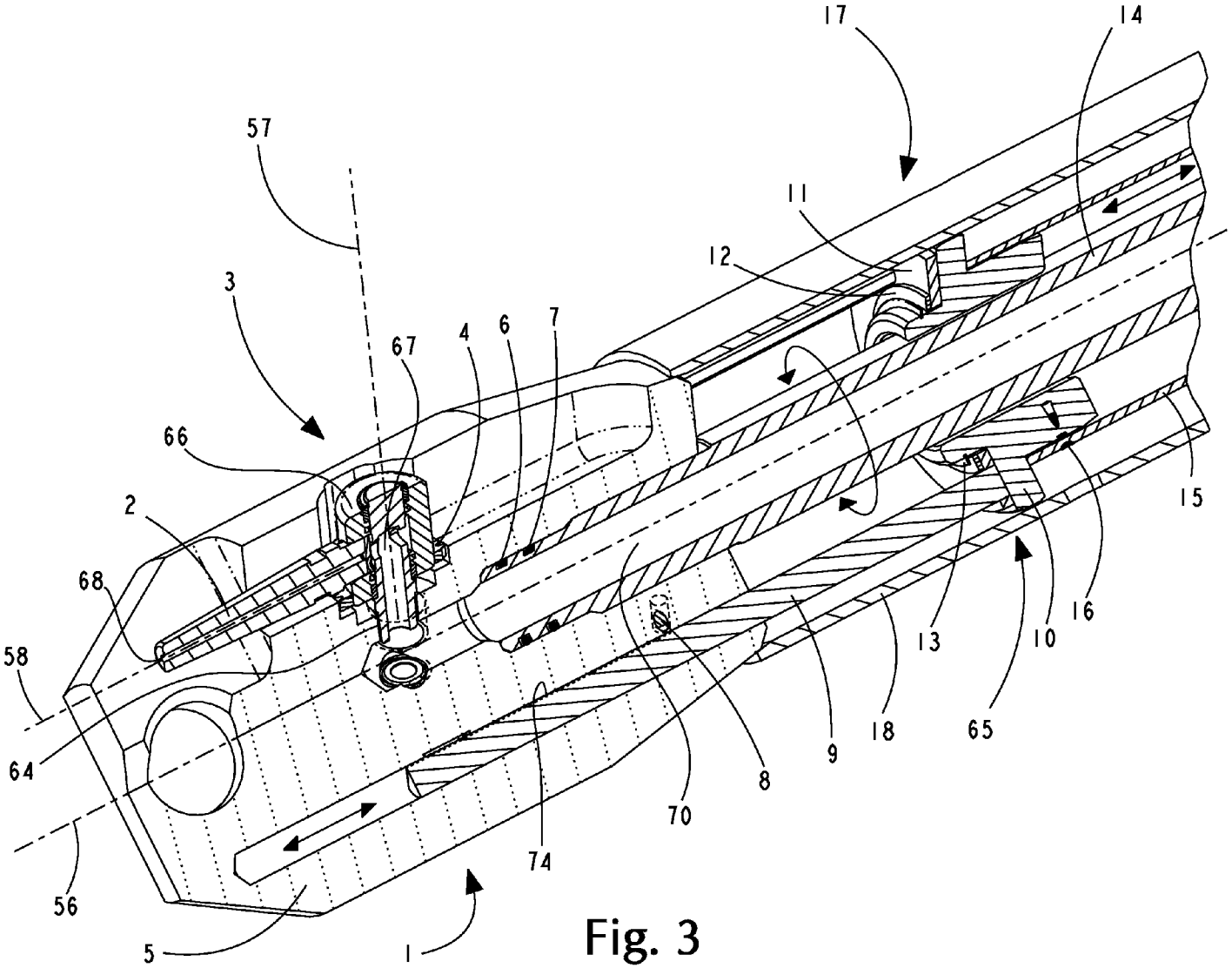
FIG. 3 is a schematic perspective cross-sectional view of a turret head assembly.
Figure 4A:
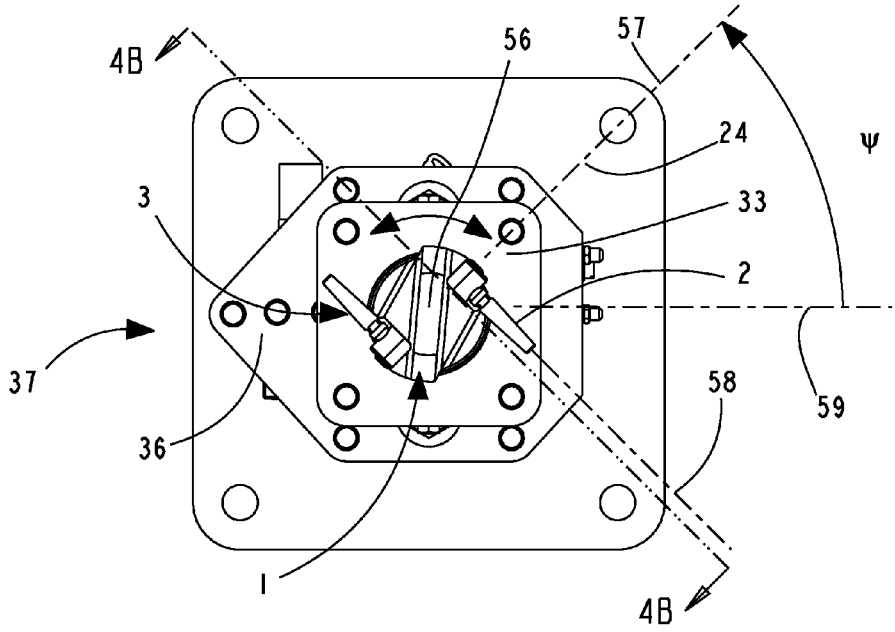
FIG. 4A is a schematic end view of the articulating nozzle assembly shown in FIG. 1.
Figure 4B:
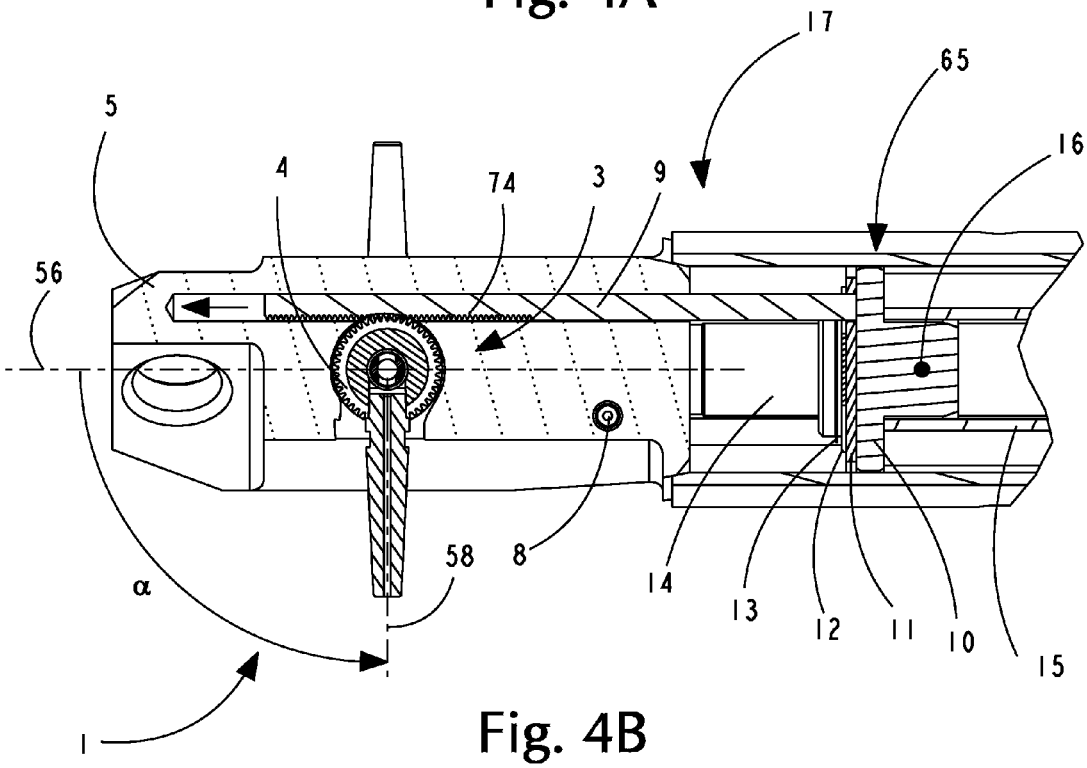
FIG. 4B is a schematic cross-sectional view of the articulating nozzle assembly taken along the line shown in FIG. 4A.

FIG. 3 is a schematic perspective cross-sectional view of a turret head assembly. FIG. 4A is a schematic end view of the articulating nozzle assembly shown in FIG. 1. FIG. 4B is a schematic cross-sectional view of the articulating nozzle assembly taken along the line shown in FIG. 4A. The figures will be described in conjunction with each other.

FIG. 3 illustrates the turret head assembly 1 that includes a turret head housing 5 and at least one nozzle rotary union assembly 3 having a body 66 coupled to at least one nozzle 2. The nozzle rotary union assembly 3 is coupled to the turret head housing 5 and can rotate around a union assembly axis 57. The angle at which a centerline 58 of the nozzle 2 is rotated around the union assembly axis 57 relative to the longitudinal axis 56 of the center mast tube 14 is the pitch or azimuth angle "$\alpha$" herein, where 0 degrees is shown in FIG. 3 with the nozzle centerline 58 parallel to the longitudinal axis 56 and pointing away from the motion base assembly 23 and associated components.

In at least one embodiment, the body 66 of the nozzle rotary union assembly 3 includes a male set of threads 64 that can be threaded into a corresponding female set of threads on the turret head housing 5 of the turret head assembly 1 for coupling thereto. The center of the nozzle rotary union assembly 3 establishes a flow passage 67 to allow cleaning fluid to flow from a flow passage 70 in the center mast tube 14 through the nozzle rotary union assembly 3 and out a flow passage 68 in the nozzle 2. The nozzle rotary union assembly 3 is further threaded with threads 65 to allow the nozzle to be threadably engaged with the nozzle rotary union assembly. The nozzle rotary union assembly 3 is shown with the narrow beam nozzle jet 2. The nozzle can be varied in size, spray pattern, flow rates, and so forth. In practice and due to clearances necessary for installation, it is envisioned that in at least some embodiments, the nozzle 2 will be installed to the nozzle rotary union assembly after the nozzle rotary union assembly is installed to the turret head housing 5. One exemplary and nonlimiting source of a rotary union assembly is from Rotary Systems, Inc. of Minneapolis, Minn. While the above embodiment has been described in terms of threaded engagements and installations, other fastening systems are envisioned such as snap rings, retaining screws, adhesives, welding, or other attachment methods and systems.

The turret head assembly 1 can be rotated about the longitudinal axis 56 of the mast assembly 17 by the center mast tube 14. The turret head assembly 1 and the center mast tube 14 can be coupled with a retaining bolt 8 (shown out of plane in FIG. 3 and also shown in FIG. 4B.) The retaining bolt disposed through the turret head assembly can engage a contoured surface on the center mast tube, so that the components are coupled. The center mast tube 14 is coupled on a distal end to a gear and other components used to rotate the mast tube, described in reference to FIG. 6 below. The turret head housing 5 is sealed to the center mast tube 14 by a turret primary O-ring 6 and, in some embodiments, a turret secondary O-ring 7.

The mast assembly 17 houses the non-rotating push tube 15 that drives the pitch motion for the azimuth angle by linearly translating back and forth a rack 9 with rack teeth 9A along the longitudinal axis 56 which in turn rotates a gear 4 coupled to the nozzle 2 to change the nozzle pitch, described below.

Because the center mast tube 14 rotates the turret head assembly 1 with the rack 9, and yet the non-rotating push tube 5 linearly moves the rack 9 within the turret head assembly, a solution is needed to decouple the rotation of the rack 9 from the non-rotation of the push tube that moves the rack. The solution is to provide a swash assembly 65. The swash assembly 65 includes a swash base 10, a swash plate 11, and a retainer 13. The swash base 10 is coupled to the push tube 15. The swash plate 11 is coupled to the rack 9 and, through the rack, to the turret head assembly 1, but rotationally decoupled from the swash base 10. The retainer 13 linearly couples the swash base 10 and the swash plate 11, but allows the base 10 to be rotationally decoupled with the plate 11. A thrust washer 12 can be inserted into the assembly between the retainer 13 and the swash plate 11. The swash plate 11 therefore can rotate independently of the swash base 10, while the swash plate 11 can linearly translate with the swash base 10. Intermediate washers and other surfaces (not shown) disposed between the rotating swash plate 11 and the stationary swash base 10 and/or retainer 13 can assist in reducing rotational friction therebetween. The center mast tube 14 is also rotationally decoupled from the swash base 10 and acts as a driver for rotation of the turret head assembly 1. The swash base 10 can be attached to the push tube 15 by the push tube retainer screws 16 or the fasteners or coupling methods.

In FIG. 4A, the end of the articulating nozzle assembly 37 shows two nozzles 2, each coupled to a nozzle rotary union assembly 3 extending outward from the turret head assembly 1, which rotates about the centerline 56. Other numbers of nozzles can be used. Other features shown in the view are the motion base plate 24, top plate 33, and middle plate 36 that form support structures to support various components of the assembly and are described in more detail herein. A heading, as angle "ψ", of a nozzle on the turret head assembly 1 is a relative angle of the union assembly axis 57 of the nozzle rotary union assembly 3 measured in a counter clockwise direction around the longitudinal axis 56, referenced from an arbitrary plane from the orientation shown in FIG. 4A, such as a horizontal plane 59 passing through the axis 56. Thus, the indicated nozzle 2 is at an approximate heading angle of 45 degrees in this illustration. Generally, but not necessarily, the nozzles are balanced in their outlet directions when multiple nozzles are used, so that a minimum sideways resulting force is created by the nozzle spray to the mast assembly described herein.

The cross section in FIG. 4B, denoted by section lines 4B-4B in FIG. 4A, shows that the pitch translation motion is transferred from the swash plate 11 through the turret head housing 5 via the pitch racks 9 having gear teeth 74 to rotate the azimuth of the nozzle rotary union assembly 3 by driving the nozzle union pitch gear 4 through a rotary clockwise or counter clockwise motion.

Figures 5A, 5B, 5C:
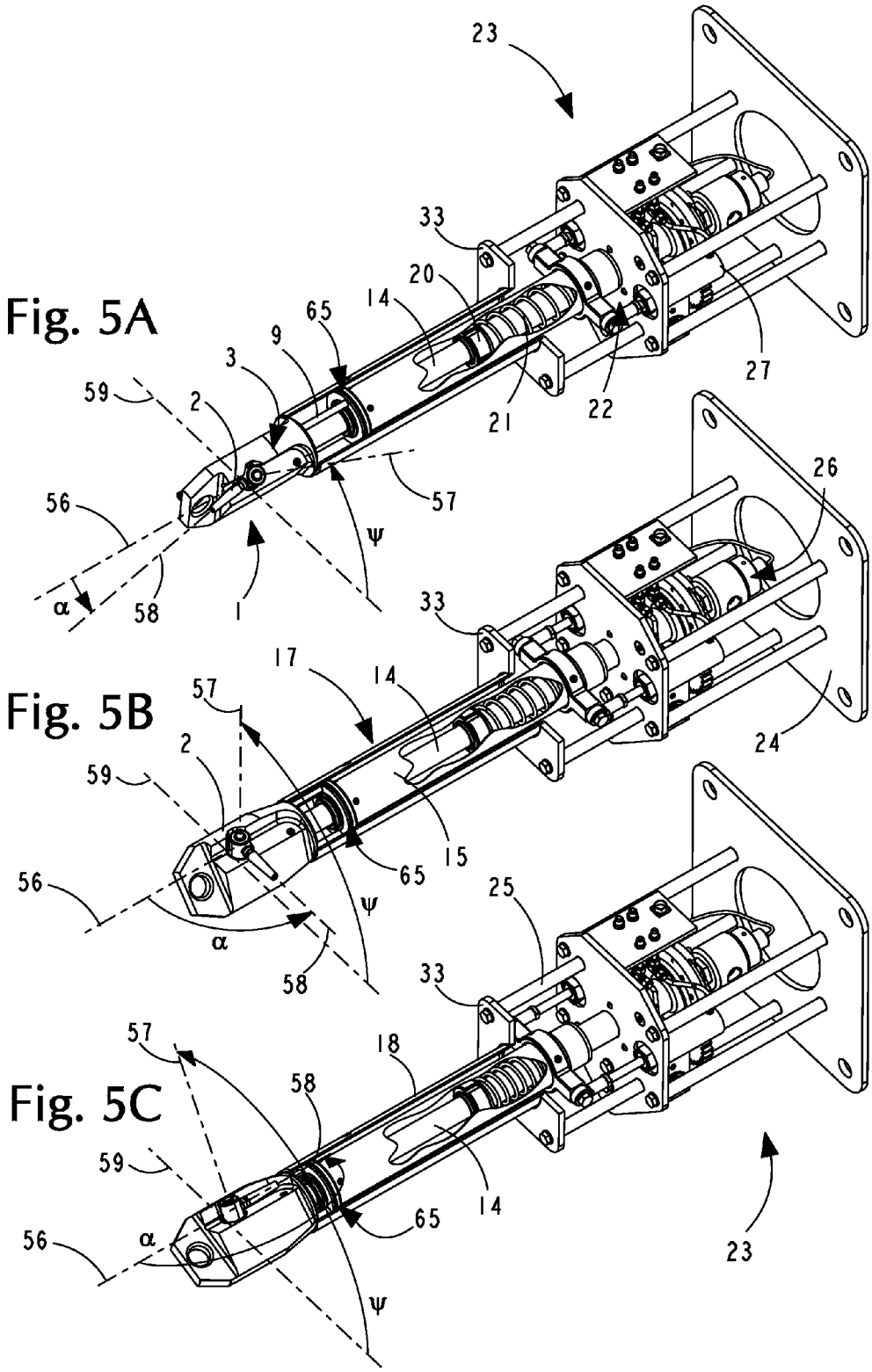
FIG. 5A is a schematic perspective view, partially cut away, showing a nozzle at an exemplary azimuth angle of 10 degrees and an exemplary heading angle of 45 degrees.
FIG. 5B is a schematic perspective view, partially cut away, showing a nozzle at an exemplary azimuth angle of 90 degrees and an exemplary heading angle of 90 degrees.
FIG. 5C is a schematic perspective view, partially cut away, showing a nozzle at an exemplary azimuth angle of 180 degrees and an exemplary heading angle of 135 degrees.

FIG. 5A is a schematic perspective view, partially cut away, showing a nozzle at an exemplary azimuth angle of 10 degrees and an exemplary heading angle of 45 degrees. The motion base assembly 23 generates the heading angle "ψ" of the turret head assembly 1 described above, and generates the pitch ("azimuth") as angle "α" of the turret head assembly. As the hydraulic cylinder 27 extends, the push tube actuator assembly 22 translates along the longitudinal axis of the articulating nozzle assembly, compressing the push tube return spring 21 against the push tube spring stop 20 and moving toward the turret head assembly 1 to cause the translation of the swash assembly 65. As the swash assembly 65 translates, it moves the pitch rack (shown in FIG. 3) and rotates the pitch gear 4 to change the azimuth angle "α".

FIG. 5B is a schematic perspective view, partially cut away, showing a nozzle at an exemplary azimuth angle of 90 degrees and an exemplary heading angle of 90 degrees. The nozzle outlet is pointed perpendicularly to the centerline 56 at the azimuth angle of 90 degrees, and is approximately parallel to the horizontal plane 59 shown in FIG. 4B.

FIG. 5C is a schematic perspective view, partially cut away, showing a nozzle at an exemplary azimuth angle of 180 degrees and an exemplary heading angle of 135 degrees. The nozzle outlet is pointed parallel to the centerline 56 and backward from the end of the turret head assembly 1 at the azimuth angle of 180 degrees, and with a heading angle of 135 degrees.

Figure 6:
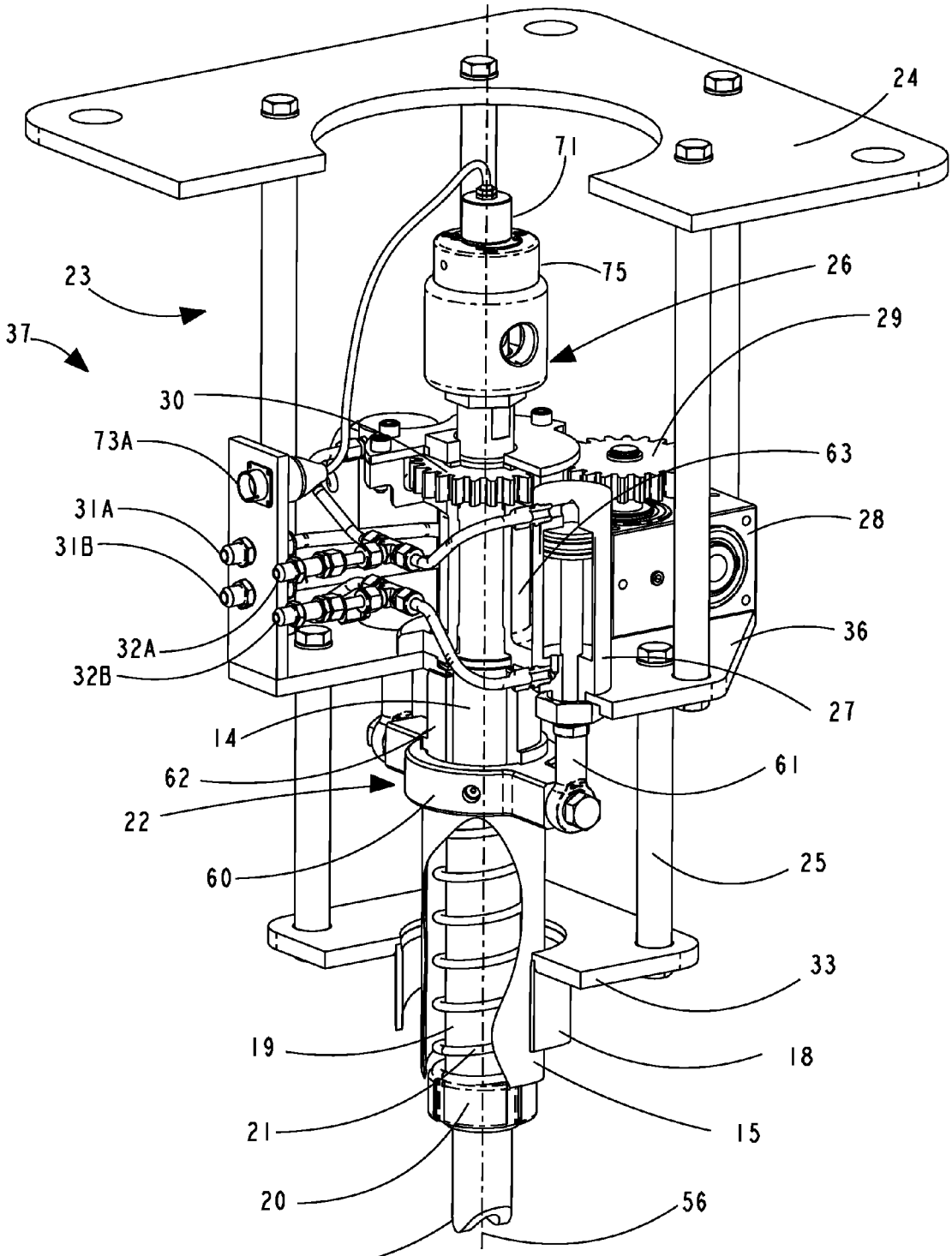
FIG. 6 is a schematic perspective view, partially cut away, detailing a pitch mechanism for the azimuth angle of the articulating nozzle.

FIG. 6 is a schematic perspective view, partially cut away, detailing a pitch mechanism for the azimuth angle of the articulating nozzle. The motion base plate 24 can be useful for mounting the other components of the articulating nozzle assembly 37 thereto and itself can be mounted to surfaces of the enclosed volume 44, shown in FIGS. 1 and 2. A motion base assembly 23 includes various components used for causing the movements to the articulating nozzles. In one exemplary embodiment, the motion base assembly 23 can include three plates coupled together and separated by supports. The middle plate 36 is a structure to which the hydraulic cylinders 27 are attached, and is separated by supports from the base plate 24. A top plate 33 is a structure coupled to the middle plate 36 and is separated from the middle plate 36 by the supports 25. A stationary mast sleeve tube 18 can be coupled to the top plate 33 as a protector for the mast 17. The longitudinal position of the turret head assembly 1, shown in FIG. 5A, relative to the top plate 33 and the motion base assembly 23 is fixed through the center mast tube 14.

As described above, the push tube actuator assembly 22 can be coupled to the push tube 15 and reciprocally move the push tube within the mast sleeve tube 18. A push tube return spring 21 is disposed around a spring tube 19. A spring stop 20 is threadably coupled to the spring tube 19 and thus restricts the maximum movement of the push tube return spring 21, when the spring engages the spring stop for compression. The spring tube 19 is coupled to the middle plate 36, which fixes the spring tube and spring stop 20 in linear movement. The center mast tube 14 is centrally disposed within the spring tube 19.

A push tube engagement member 60 is formed around the spring tube 19 and engages the push tube 15. In at least one non-limiting embodiment, the push tube engagement member can be resemble a collar surrounding spring tube 19, although other shapes and arrangements can be suitable. The push tube engagement member 60 is rotationally decoupled from the center mast tube 14. The push tube engagement member 60 linearly moves the push tube 15 to change the nozzle pitch, discussed herein. A push tube return stop 62, coupled to the middle plate 36, limits the linear motion of the push tube 15 in the direction away from the turret head assembly 1.

One or more hydraulic cylinders 27 having a cylinder rod 61 are coupled to the push tube engagement member 60. A first connection 32A and a second connection 32A (generally "32") can receive and deliver fluid to actuate the hydraulic cylinder depending on which direction the piston in the hydraulic cylinder is translating. The connections 32 can be coupled to the pitch control power line 45 and thence to the pitch control power supply 46, shown in FIG. 2. The hydraulic cylinders 27 can be paired together by combining the extension and retraction ports of each cylinder to the connections 32A, 32B, respectively.

Because the turret head assembly 1, shown in FIG. 5A, is longitudinally fixed in relation to the top plate 33 and the motion base assembly 23, then by moving the push tube actuator assembly 22 relative to the turret head assembly 1, the pitch rack 9 can move relative to the pitch gear 4 and change the pitch (azimuth angle "α") for the nozzles.

In spite of the control of the azimuth angle through a centrally located push tube 15 in the turret head assembly 1, the rotation of the center mast tube 14 can independently cause the turret head assembly 1 to rotate. The center mast tube 14 is decoupled from the system components that translate longitudinally, including the push tube engagement member 60, spring 21, and push tube 15. The center mast tube 14 can be rotated using a center mast driven gear 30 that is engagable with a drive gear 29. The drive gear 29 is actuated by a motor 34 (shown in FIG. 7). Depending on the characteristics of the motor, a gear box 28 can be coupled between the drive gear 29 and the motor to adjust the overall speed of the drive gear. A heading position sensor 71 can be mounted to a heading sensor mount 75 and provide feedback on the heading of the turret head assembly 1, shown in FIG. 4A. The heading position sensor 71 can provide input to the control center 52, shown in FIG. 2, through a port 73A coupled to the feedback control line 73.

As described in FIG. 5A, when the hydraulic cylinder 27 extends, the push tube actuator assembly 22 translates along the longitudinal axis 56 of the articulating nozzle assembly 37, compressing the push tube return spring 21 against the push tube spring stop 20 and moving toward the turret head assembly 1 to cause the translation of the swash assembly 65 with the swash plate 11. Further, the push tube return spring 21 forces the push tube actuator assembly 22, coaxially located on the spring tube 19, to translate back towards the motion base plate 24, causing the hydraulic cylinders 27 to retract in case of loss of hydraulic pitch control, and to position the nozzle jet 2 in the home position of 0 degrees azimuth, shown in FIG. 3.

Figure 7:
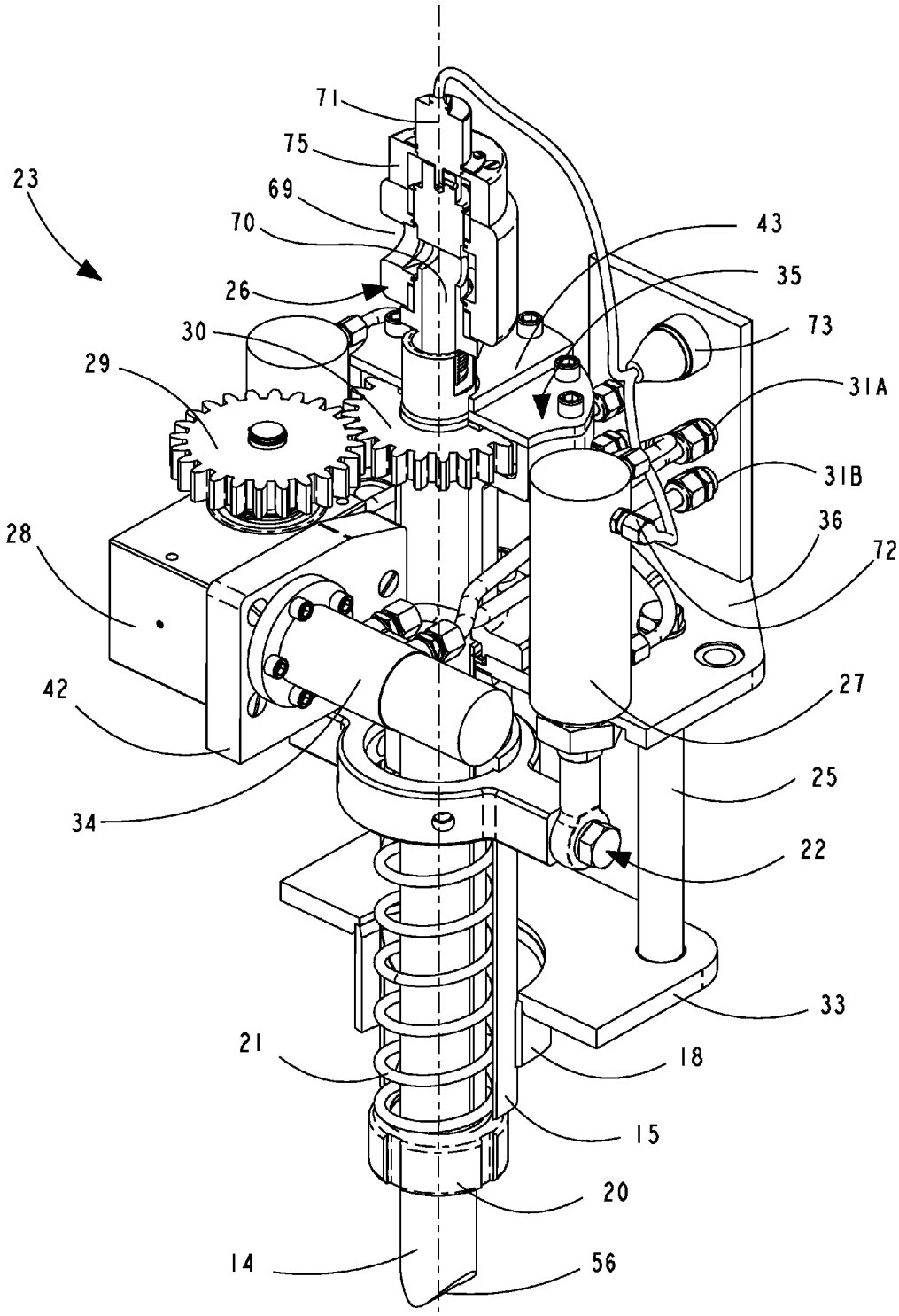
FIG. 7 is a schematic perspective view, partially cut away, detailing the heading mechanism for the heading angle of the articulating nozzle.

FIG. 7 is a schematic perspective view, partially cut away, detailing the heading mechanism for the heading angle of the articulating nozzle. The center mast tube 14 is coupled rotationally coupled to the gear center mast driven gear 30 disposed in a center mast gear housing assembly 35. The driven gear 30 is engagable with a drive gear 29. The drive gear 29 can be rotationally coupled to a gear box 28. The gear box can change the rotational speed of a motor to a different speed. For example and without limitation, the gear box 28 can have a reduction ratio of 40:1, so that the rotational output speed to the gear box is reduced 40 times slower than a rotational input speed. The gear box 28 can be coupled to a motor 34. The motor can be a reversible, variable speed hydraulic motor. Power to the motor can be supplied by one or more connections 31A, 31B (collectively "31"). The connections 31 can be coupled to the rotary control power line 47, which is coupled to the rotary control power supply 48, shown in FIG. 2. The motor 34 and gearbox 28 can be coupled to the middle plate 36 by the motor mount 42. The motor mount 42 coupling with the middle plate 36 can be designed to allow changes to the interface clearance between the driven gear 30 and drive gear 29, known as a "lash". A gear housing 64 and a gear housing cover 43 can beneficially cover at least a portion of the components for safety and cleanliness.

Rotary motion in the center mast tube 14 is caused by the rotary control power source providing power to the motor 34 and rotating the gear box to rotate the drive gear 29, the driven gear 30, and the center mast tube 14.

To assist the system in determining the heading angle of the nozzle on the turret head assembly, the system can include at least one sensor 71 to indicate the position of the nozzle. For example and without limitation, the sensor 71 can be coupled to a heading sensor mount 75 or another relatively stationary portion and sense the rotational movement of the drive gear 29, center mast driven gear 30, center mast tube 14, or a combination thereof. The sensor 71 can be calibrated when the nozzle is at a known position, such as zero degrees heading and calibrated at another heading, such as a full rotation at 360 degrees heading, so that as the center mast tube rotates with the turret head assembly and the nozzle, the angle and therefore rotational position of the nozzle can be determined. The sensor 71 can transmit or otherwise communicate the sensor readings to the control center 52 through a port 73A coupled to the feedback control line 73. If digitally encoded, the sensor readings can be sent to a controller 53A and processed in the server 53.

To assist the system in determining the azimuth angle for the pitch of the nozzle, the system can include at least one sensor 72 to indicate the position of nozzle. For example and without limitation, the sensor 72 can be coupled to a hydraulic cylinder 27, the middle plate 36, or another relatively stationary portion and sense the movement of the cylinder rod 61 of the hydraulic cylinder 27, push tube engagement member 60, some other moving portion related to the pitch, or a combination thereof. The sensor 72 can be calibrated when the nozzle is at a known position, such as zero degrees pitch, and calibrated at another angle, such as 180 degrees, so that the angles therebetween can be determined based on the output from the sensor. The sensor can transmit or otherwise communicate the sensor readings to the control center 52, shown in FIG. 2, through a port 73A coupled to the feedback control line 73. If digitally encoded, the sensor readings can be sent to a controller 53A and processed in the server 53.

Thus, the pitch of the nozzles can be variable and reversible as the push tube moves back and forth. Similarly, the heading of the nozzles can be variable and reversible as the motor rotates the gears in one direction or the other, with the pitch independent of the heading. Further, the pitch and heading of the nozzles can be indexed using the feedback position sensors 71, 72.

The center mast tube 14 is also used to deliver cleaning fluid to the nozzles in the turret head assembly 1 by flowing cleaning fluid through a flow passage 70 in the center mast tube 14, through the flow passage 67 in the body of the nozzle rotary union assembly 3, and out the flow passage 68 of the nozzle 2, shown in FIG. 3. The cleaning fluid, generally at a high pressure, is delivered to the center mast tube 14 through the cleaning fluid line 49, shown in FIG. 2. A center mast rotary union assembly 26 can be used to rotationally decouple the relatively stationary cleaning fluid line from the rotating center mast tube 14. The center mast rotary union assembly 26 can include a flow passage 69 fluidicly coupled to the flow passage 70 of the central mast tube 14 and through which the cleaning fluid can enter the articulating nozzle system. A rotary union assembly is available from commercial suppliers including but without limitation rotary union assembly is from Rotary Systems, Inc., referenced above.

Other and further embodiments utilizing one or more aspects of the invention described above can be devised without departing from the spirit of the disclosed invention. For example, a different placement of one or more sensors, different supporting structures for the components, different actuators of the push tube and center mast, and other changes can be made by those having the benefit of the disclosure herein in keeping with the purposes of the invention. Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. An articulating nozzle system for cleaning, comprising:

an articulating turret head assembly and comprising:

a turret head housing;

an articulating nozzle rotary union assembly coupled to the turret head housing, comprising:

a body of the nozzle rotary union assembly coupled to the turret head housing, the body having a flow passage therethrough;

a nozzle coupled to the body of the nozzle rotary union assembly and having flow passage therethrough fluidicly coupled to the flow passage in body of the nozzle rotary union assembly; and a nozzle union pitch gear coupled to the body of the nozzle rotary union assembly;

a mast assembly coupled to the articulating turret head assembly and comprising:

a swash assembly comprising:

a swash base;

a swash plate linearly coupled with the swash base and rotationally decoupled with the swash base; and a push tube coupled with the swash base;

a rack rotationally coupled with the swash plate and turret head assembly and further slidably coupled with the turret head assembly and rotationally decoupled with the push tube, the rack being adapted to engage and rotate the nozzle union pitch gear to rotate the nozzle to different azimuth angles;

a center mast tube disposed radially within the swash assembly and passing through the swash assembly, the center mast tube being adapted to engage and cause rotation of the articulating turret head assembly independent of linear movement of the swash assembly with the rack being rotationally coupled to the center mast tube through the coupling with the articulating turret head assembly, the center mast tube further comprising a flow passage formed therethrough that is fluidicly coupled to the flow passage in the nozzle rotary union assembly and the nozzle;

the swash assembly being adapted to allow the rack to change the azimuth angle of the nozzle while the center mast tube rotates the turret head assembly coupled with the nozzle; and a motion base assembly coupled to the mast assembly, the motion base assembly having at least one support structure and comprising:

a push tube actuator assembly coupled to the at least one support structure on the base assembly, the push tube actuator assembly adapted to linearly move the push tube and the swash assembly; and a motor coupled to the at least one support structure and to the center mast tube and adapted to rotate the center mast tube and the turret head assembly.

2. The system of claim 1, wherein the push tube actuator assembly comprises:

at least one hydraulic cylinder having a cylinder rod extending therefrom;

a push tube engagement member coupled to the cylinder rod and adapted to engage the push tube and linearly move the push tube relative to the center mast tube to change the azimuth angle.

3. The system of claim 2, wherein the push tube actuator assembly further comprises:

a push tube return spring engageable with the push tube engagement member;

a push tube spring stop coupled to the at least one support structure on the motion base assembly defining a stop position of the push tube spring when the spring is compressed by the push tube engagement member;

the push tube return spring being adapted to be compressed when the push tube is linearly moved toward the turret head assembly and to bias the push tube engagement member and the push tube to a default position when no power is applied to the hydraulic cylinder.

4. The system of claim 3, wherein the push tube actuator assembly further comprises a push tube return stop adapted to limit the default position of the push tube engagement member and push tube.

5. The system of claim 1, wherein the motion base assembly further comprises:

a hydraulic motor;

a drive gear coupled to the hydraulic motor;

a center mast driven gear coupled to the center mast tube and engageable with the drive gear;

the motor adapted to rotate the center mast tube independent of the linear movement of the push tube and the swash assembly.

6. The system of claim 1, further comprising a center mast rotary union assembly linearly coupled to the center mast tube distally from the turret head assembly and decoupled rotationally from the center mast tube, the center mast rotary union assembly having a port adapted to be coupled to a cleaning fluid line, the port being fluidicly coupled to the flow passages in the center mast tube, the body of the nozzle rotary union assembly, and the nozzle.

7. The system of claim 1, further comprising a cleaning fluid power supply fluidicly coupled to the cleaning fluid line.

8. The system of claim 1, wherein the turret head housing is formed with a passage adapted to receive the rack that is adapted to engage the nozzle union pitch gear.

9. The system of claim 1, further comprising a mast sleeve tube surrounding the push tube and coupled to the at least one support structure on the motion base assembly.

10. The system of claim 2, further comprising a pitch control power line and a pitch control power supply coupled to the pitch control power line and adapted to supply power to the at least one hydraulic cylinder to actuate the cylinder.

11. The system of claim 1, further comprising a rotary control power line and a rotary control power supply coupled to the rotary control power line and adapted to supply power to the motor to actuate the motor.

12. The system of claim 1, wherein the push tube actuator is reversible and variable in speed.

13. The system of claim 1, wherein the motor adapted to rotate the center mast tube and the turret head assembly is reversible and variable in speed.

14. An articulating nozzle system for cleaning, comprising:

an articulating turret head assembly comprising:

a turret head housing;

an articulating nozzle rotary union assembly coupled to the turret head housing, comprising:

a body of the nozzle rotary union assembly coupled to the turret head housing, the body having a flow passage therethrough; and a nozzle coupled to the body of the nozzle rotary union assembly and having flow passage therethrough fluidicly coupled to the flow passage in body of the nozzle rotary union assembly;

a mast assembly coupled to the articulating turret head assembly and comprising:

a swash assembly adapted to change an azimuth angle of the nozzle, comprising:

a swash base;

a swash plate linearly coupled with the swash base and rotationally decoupled with the swash base; and a push tube coupled with the swash base and to the nozzle rotary union assembly; and a center mast tube coupled to the turret head assembly and adapted to engage and cause rotation of the articulating turret head assembly independent of linear movement of the swash assembly, the center mast tube further comprising a flow passage formed therethrough that is fluidicly coupled to the flow passage in the nozzle rotary union assembly and the nozzle; and a motion base assembly coupled to the mast assembly, comprising:

a push tube actuator assembly coupled to the base assembly, the push tube actuator assembly adapted to linearly move the push tube and the swash assembly to change an azimuth angle of the nozzle.

15. The system of claim 14, wherein the articulating nozzle rotary union assembly further comprises a nozzle union pitch gear coupled to the body of the nozzle rotary union assembly.

16. The system of claim 15, wherein the mast assembly further comprises a rack rotationally coupled with the swash plate and turret head assembly and further slidably coupled with the turret head assembly and rotationally decoupled with the push tube, the rack being adapted to engage and rotate the nozzle union pitch gear to rotate the nozzle to different azimuth angles.

17. The system of claim 16, wherein the swash assembly is adapted to allow the rack to change the azimuth angle of the nozzle while the center mast tube independently rotates the turret head assembly coupled with the nozzle.

18. The system of claim 14, further comprising a motor coupled to the center mast tube and adapted to rotate the center mast tube.

* * * * *